US011026025B2

(12) United States Patent
Xiao et al.

(10) Patent No.: US 11,026,025 B2
(45) Date of Patent: Jun. 1, 2021

(54) SPEAKER

(71) Applicant: AAC Technologies Pte. Ltd., Singapore (SG)

(72) Inventors: Bo Xiao, Shenzhen (CN); Ronglin Linghu, Shenzhen (CN); Xiaodong Liu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 45 days.

(21) Appl. No.: 16/706,796

(22) Filed: Dec. 8, 2019

(65) Prior Publication Data

US 2020/0213761 A1 Jul. 2, 2020

(30) Foreign Application Priority Data

Dec. 30, 2018 (CN) ..... 201822278290.2

(51) Int. Cl.

| | |
|---|---|
| ***H04R 9/04*** | (2006.01) |
| ***H04R 9/06*** | (2006.01) |
| ***H04R 9/02*** | (2006.01) |
| ***H04R 7/12*** | (2006.01) |
| ***H04R 7/18*** | (2006.01) |

(52) U.S. Cl.

CPC ..... *H04R 9/06* (2013.01); *H04R 7/127* (2013.01); *H04R 7/18* (2013.01); *H04R 9/025* (2013.01); *H04R 9/041* (2013.01); *H04R 2400/11* (2013.01)

(58) Field of Classification Search

CPC ..... H04R 9/025; H04R 9/043

See application file for complete search history.

(56) References Cited

U.S. PATENT DOCUMENTS

| | | | | |
|---|---|---|---|---|
| 8,995,704 | B2 * | 3/2015 | Huang | H04R 9/043 381/404 |
| 9,185,494 | B2 * | 11/2015 | Choi | H04R 9/043 |
| 9,813,818 | B2 * | 11/2017 | Wu | H04R 9/043 |
| 9,936,302 | B2 * | 4/2018 | Linghu | H04R 7/18 |
| 10,057,691 | B2 * | 8/2018 | Linghu | H04R 7/18 |
| 10,091,570 | B2 * | 10/2018 | Xiao | H04R 1/06 |
| 10,187,730 | B1 * | 1/2019 | Zhu | G06F 1/1688 |
| 10,277,986 | B2 * | 4/2019 | Li | H04R 9/043 |
| 10,728,672 | B2 * | 7/2020 | Kim | H04R 9/045 |

(Continued)

FOREIGN PATENT DOCUMENTS

| | | | | |
|---|---|---|---|---|
| CN | 205961438 U | * | 2/2017 | H04R 9/025 |

*Primary Examiner* — Ryan Robinson

(74) *Attorney, Agent, or Firm* — W&G Law Group LLP

(57) ABSTRACT

A speaker includes a holder, a magnetic circuit unit, and a vibration unit including a diaphragm, a voice coil, and a centering support plate. The centering support plate is fixed to a side of the voice coil facing away from the diaphragm. One end of the centering support plate fixed to the voice coil is provided with a pad electrically connected to the voice coil. The diaphragm includes a central portion, a suspension portion surrounding the central portion, and a dome fixed to the central portion. The dome includes a body attached to the central portion, and a connection portion extending from an edge of the body towards the pad and fixedly connected to the pad. With the connection portion, the pad of the centering support plate can be fixed, preventing the tone quality of the speaker from being damaged by the pad, and t reducing noise.

10 Claims, 3 Drawing Sheets

(56) References Cited

U.S. PATENT DOCUMENTS

| | | | | |
|---|---|---|---|---|
| 10,750,289 | B2 * | 8/2020 | Zhang | H04R 9/043 |
| 2017/0339478 | A1 * | 11/2017 | Xiao | H04R 9/025 |
| 2018/0027336 | A1 * | 1/2018 | Li | H04R 9/06<br>381/398 |
| 2018/0124520 | A1 * | 5/2018 | Schoeffmann | H04R 9/02 |
| 2020/0045433 | A1 * | 2/2020 | Hu | H04R 9/043 |
| 2020/0137500 | A1 * | 4/2020 | Moenke | H04R 9/043 |
| 2020/0382874 | A1 * | 12/2020 | Fukada | H04R 7/18 |

* cited by examiner

SPEAKER

TECHNICAL FIELD

The present invention relates to the technical field of electroacoustic conversion technologies, and particularly, to a speaker.

BACKGROUND

With the advent of the mobile internet era, various smart mobile devices continuously emerge. Among the various mobile devices, mobile phones are undoubtedly the most common and portable mobile terminal devices. At present, mobile phones have extremely diverse functions, one of which is high-quality music displaying. Therefore, speakers for playing sound are widely used in smart mobile devices nowadays.

In the related art, a speaker includes a holder, a diaphragm fixed to the holder, a magnetic circuit unit fixed to the holder, a voice coil configured to drive the diaphragm to vibrate, and a centering support plate communicating the voice coil with the outside of the holder. The centering support plate is provided with a pad configured to weld a lead wire of the voice coil. However, the pad is often suspended and unfixed, which may result in damage to the tone quality of the speaker and noise generation.

In view of the above, it is urgent to provide a new speaker to solve the above technical problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present invention. Moreover, in the drawings, like reference numerals designate corresponding parts throughout the several views.

DESCRIPTION OF EMBODIMENTS

The present invention will hereinafter be described in detail with reference to several exemplary embodiments. To make the technical problems to be solved, technical solutions and beneficial effects of the present invention more apparent, the present invention is described in further detail together with the figure and the embodiments. It should be understood the specific embodiments described hereby is only to explain the invention, not intended to limit the invention.

Figure 1:
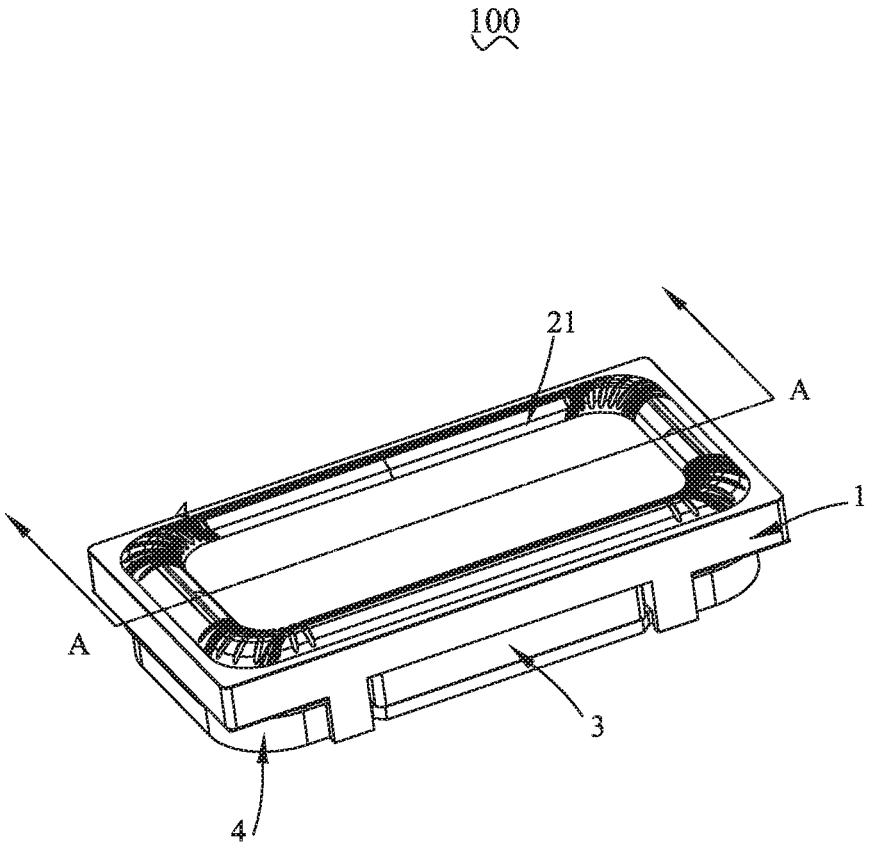
FIG. 1 is a perspective view of a speaker according to an embodiment of the present invention.
Figure 2:
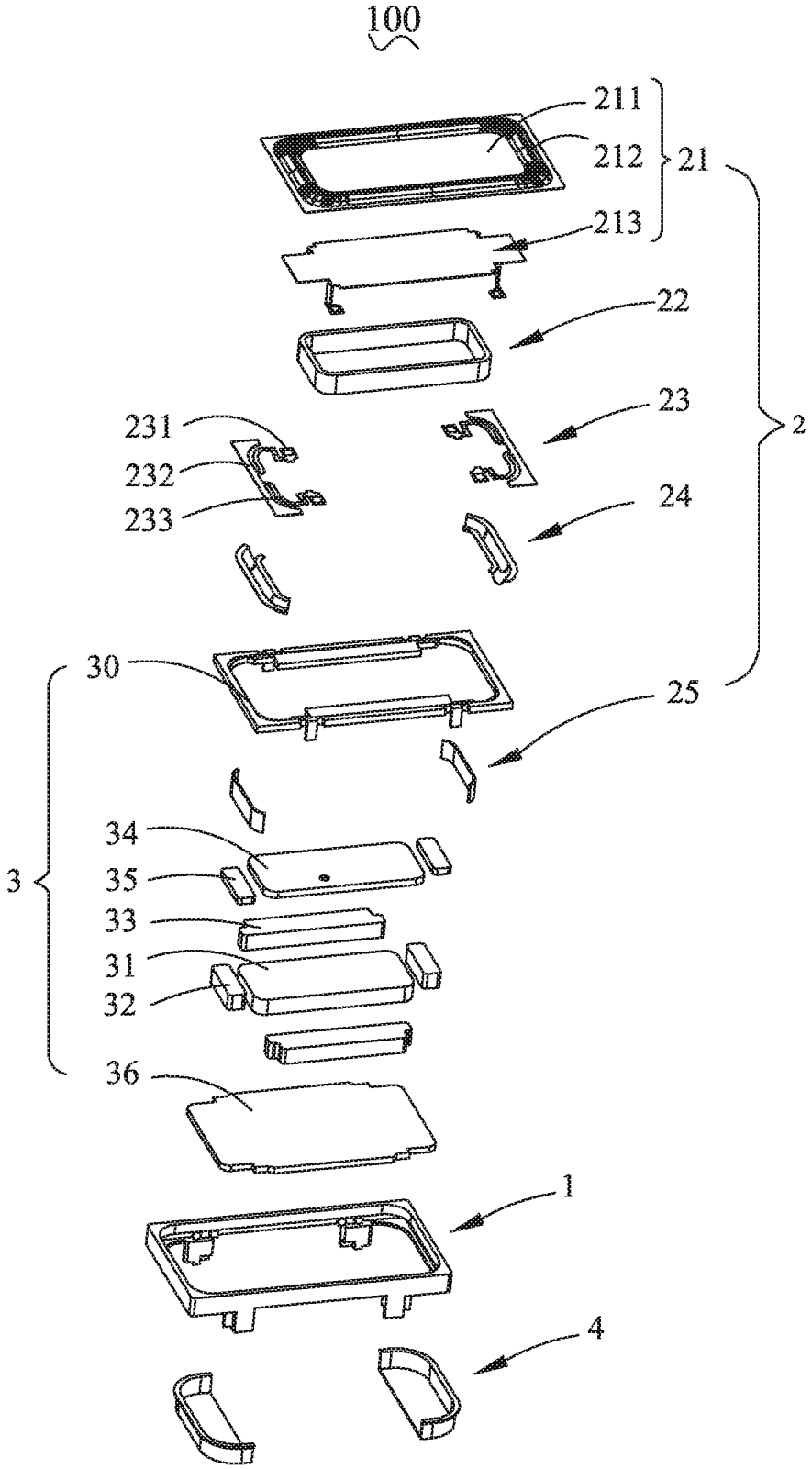
FIG. 2 is an exploded view of the speaker shown in FIG. 1.
Figure 3:
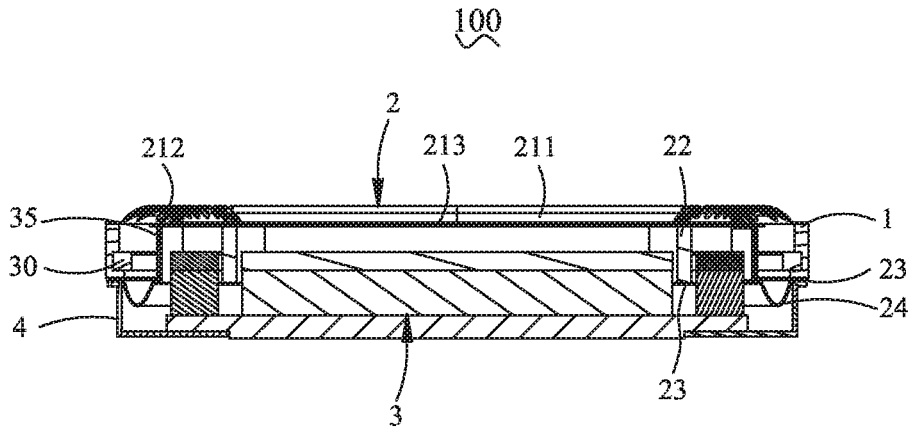
FIG. 3 is a cross-sectional view of the speaker taken along line A-A shown in FIG. 1.

As shown in FIG. 1 to FIG. 3, the present invention provides a speaker 100. The speaker 100 includes a holder 1, a vibration unit 2, and a magnetic circuit unit 3. The vibration unit 2 and the magnetic circuit unit 3 are received in the holder 1. The holder 1 is made of plastic. The magnetic circuit unit 3 is configured to generate a constant magnetic field. The vibration unit 2 receives an external electric signal, so as to interact with the constant magnetic field generated by the magnetic circuit unit 3 and generate an electromagnetic force. Further, the vibration unit 2 is driven by the electromagnetic force to vibrate and emit sound.

The vibration unit 2 includes a diaphragm 21, a voice coil 22, centering support plates 23, voice membranes 24, and a support frame 25. The voice coil 22 is configured to drive the diaphragm 21 to vibrate and emit sound. One end of the centering support plate 23 is fixed to the holder 1, and the other end thereof is fixed to the voice coil 22. The voice membrane 24 is fixedly connected to the centering support plate 23.

The centering support plate 23 is fixed to an end of the voice coil 22 facing away from the diaphragm 21. The end of the centering support plate 23 fixed to the voice coil 22 is provided with a pad 231 electrically connected to the voice coil 22. Each centering support plate 23 include two pads 231, and the two pads 231 are symmetrically arranged with respect to a long axis direction of the voice coil 22. The centering support plate 23 includes a fixing portion 232 fixed to the holder 1, an elastic arm 233 extending from the fixing portion 232 while being bent towards the voice coil, and the pad 231 connected to an end of the elastic arm 233 facing away from the fixing portion 232. The end of the elastic arm 233 facing away from the fixing portion 232 is supported on a side of the voice coil 22 facing away from the diaphragm 21.

The voice membrane 24 is recessed towards a direction facing away from the elastic arm 233 along a vibrating direction of the diaphragm 21.

Figure 4:
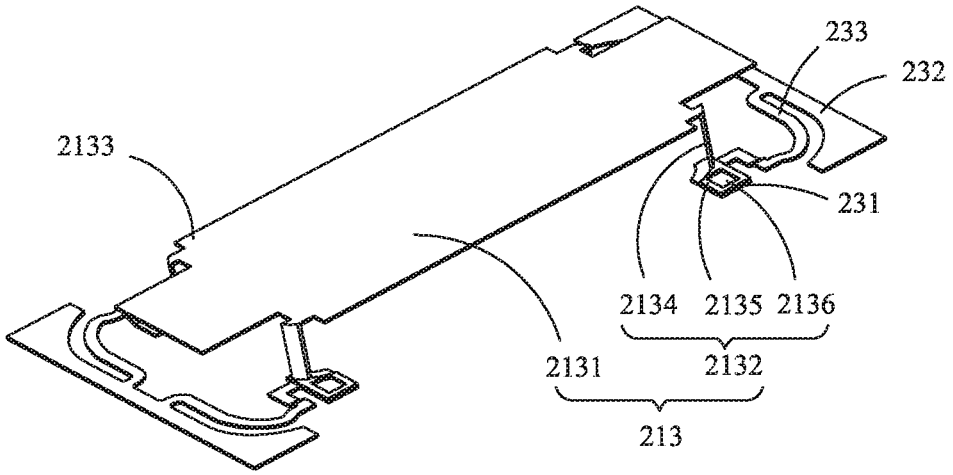
FIG. 4 is a perspective assembled view for a dome and a centering support plate shown in FIG. 2.

As shown in FIG. 3 to FIG. 4, the diaphragm 21 includes a central portion 211, a suspension portion 212 surrounding the central portion 211, and a dome 213 fixed to a side of the central portion 211 close to the voice coil 22. The dome 213 includes a body 2131 attached to the central portion 211, and a connection portion 2132 extending from an edge of the body 2131 towards the pad 231 and fixedly connected to the pad 231. In an embodiment, the connection portion 2132 is arranged correspondingly to a corner of the voice coil 22.

The connection portion 2132 includes an extension arm 2134 extending from an edge of the body 2131 towards the pad 231, and a positioning portion 2135 extending from the extension arm 2134 while being bent and fixed to the pad 231. The extension arm 2134 extends along an outer side of the voice coil 22 and is attached to the voice coil 22. A positioning hole 2136 is formed by penetrating the positioning portion 2135. The pad 231 is partially exposed to the interior of the speaker 100 through the positioning hole 2136.

The magnetic circuit unit 3 includes a main magnet 31, auxiliary magnets 32, edge magnets 33, a main pole plate 34, auxiliary pole plates 35, and a yoke 36. The main magnet 31 is arranged correspondingly to the central portion 211. An end of the voice coil 22 facing away from the diaphragm 21 is disposed on and surrounds an outer circumference of the main magnet 31. The auxiliary magnets 32 are fixed between the voice membrane 24 and the main magnet 31. The voice coil 22 is of a racetrack type. The auxiliary magnets 32 are symmetrically arranged at two ends of the voice coil 22 along a long axis direction thereof. The edge magnets 33 are fixed to two ends of the voice coil 22 along a short axis direction thereof. Each edge magnet 33 and each auxiliary magnet 32 are spaced apart from the main magnet 31. The main pole plate 34 and the auxiliary pole plates 35 are attached to upper surfaces of the main magnet 31 and the auxiliary magnets 32, respectively. The main magnet 31 and the auxiliary magnets 32 are fixed to the yoke 36. In an embodiment, the magnetic circuit unit 3 further includes a magnetic conductive plate 30 embedded in the holder. The magnetic conductive plate 30 covers a side of the edge magnet 33 facing away from the yoke 36.

The pad 231 extends from the elastic arm 233 towards a direction facing away from the main magnet 31.

The dome 213 further includes an extension portion 2133 extending from an edge of the body 2131 and located between the suspension portion 212 and the auxiliary magnet 32. The vibration unit 2 further includes a support frame 25 sandwiched between the voice membrane 24 and the extension portion 2133. A side of the voice membrane 24 facing away from the fixing portion 232 is fixed to the support frame 25. The auxiliary magnet 32 is located between the support frame 25 and the voice coil 22.

The speaker 100 further includes a dustproof member 4 fixed under the holder 1. Two dustproof members 4 are provided, and the dustproof members 4 are respectively located at two ends of the holder 1 along the long axis direction.

The speaker provided by the present invention has the following beneficial effects. With the connection portion extending from the edge of the dome towards the pad and fixedly connected to the pad, the pad of the centering support plate can be fixed, preventing the tone quality of the speaker from being be damaged by the pad, and reducing noise.

The above described embodiments are merely intended to illustrate the present invention, and it should be noted that, without departing from the inventive concept of the present invention, the improvements made by those skilled in the related art shall fall within the protection scope of the present invention.

What is claimed is:

1. A speaker, comprising:

a holder;

a magnetic circuit unit received in the holder; and a vibration unit received in the holder, wherein the vibration unit comprises:

a diaphragm;

a voice coil configured to drive the diaphragm to vibrate; and a centering support plate, one end of the centering support plate being fixed to the holder and the other end of the centering support plate being fixed to the voice coil, the centering support plate being fixed to a side of the voice coil facing away from the diaphragm, the end of the centering support plate fixed to the voice coil is provided with a pad electrically connected to the voice coil, wherein the diaphragm comprises:

a central portion;

a suspension portion surrounding the central portion; and a dome fixed to a side of the central portion close to the voice coil, the dome comprising a body attached to the central portion, and a connection portion extending from an edge of the body towards the pad and fixedly connected to the pad.

2. The speaker as described in claim 1, wherein the magnetic circuit unit comprises a main magnet arranged correspondingly to the central portion, the side of the voice coil facing away from the diaphragm is disposed at an outer circumference of the main magnet, the centering support plate comprises a fixing portion fixed to the holder, an elastic arm extending from the fixing portion while being bent towards the voice coil, and the pad connected at an end of the elastic arm facing away from the fixing portion.

3. The speaker as described in claim 2, wherein the end of the elastic arm facing away from the fixing portion is supported on the side of the voice coil facing away from the diaphragm, and the pad extends from the elastic arm in a direction facing away from the main magnet.

4. The speaker as described in claim 2, wherein the vibration unit further comprises a voice membrane fixedly connected to the centering support plate, and the voice membrane is recessed in a direction facing away from the elastic arm along a vibrating direction of the diaphragm.

5. The speaker as described in claim 4, wherein the magnetic circuit unit further comprises auxiliary magnets each fixed between the voice membrane and the main magnet, the dome further comprises an extension portion extending from an edge of the body and located between the suspension portion and each of the auxiliary magnets, the vibration unit further comprises a support frame sandwiched between the voice membrane and the extension portion, a side of the voice membrane facing away from the fixing portion is fixed to the support frame, and each of the auxiliary magnets is located between the support frame and the voice coil.

6. The speaker as described in claim 5, wherein the voice coil is of a racetrack type, and the auxiliary magnets are symmetrically arranged at two ends of the voice coil along a long axis direction thereof, the magnetic circuit unit further comprises edge magnets fixed at two ends of the voice coil along a short axis direction thereof, and the edge magnets and the auxiliary magnets are each spaced apart from the main magnet.

7. The speaker as described in claim 1, wherein the connection portion comprises an extension arm extending from an edge of the body towards the pad, and a positioning portion extending from the extension arm while being bent and fixedly attached to the pad, a positioning hole is formed by penetrating the positioning portion, and the pad is partially exposed to an interior of the speaker through the positioning hole.

8. The speaker as described in claim 7, wherein the extension arm extends along an outer side of the voice coil and is attached to the voice coil.

9. The speaker as described in claim 6, wherein the centering support plate comprises two pads, and the two pads are symmetrically arranged with respect to the long axis direction of the voice coil.

10. The speaker as described in claim 6, wherein the connection portion is arranged correspondingly to a corner of the voice coil.

* * * * *